United States Patent [19]

Miyasita et al.

[11] 4,129,289

[45] Dec. 12, 1978

[54] SHAFT FURNACE WITH BOTTOM DISCHARGE DEVICE

[75] Inventors: Satoru Miyasita; Masahiko Taniguchi, both of Himeji; Katsuyoshi Kobayashi, Kitakyushu, all of Japan

[73] Assignee: Nippon Steel Corporation, Tokyo, Japan

[21] Appl. No.: 780,014

[22] Filed: Mar. 22, 1977

[30] Foreign Application Priority Data

Mar. 26, 1976 [JP] Japan ..... 51/33242

[51] Int. Cl.[2] ..... C21B 7/14

[52] U.S. Cl. ..... 266/195

[58] Field of Search ..... 214/33, 35 R; 222/200, 222/409, 457, 222, 342, 353, 410; 266/195, 177, 44; 432/95, 139; 239/659

[56] References Cited

U.S. PATENT DOCUMENTS

| | | | |
|---|---|---|---|
| 2,602,670 | 7/1952 | Burkart | 239/687 |
| 2,626,482 | 1/1953 | Munday et al. | 222/410 |
| 2,709,537 | 5/1955 | Taylor | 222/410 |
| 3,580,717 | 5/1971 | Kononov | 266/195 |
| 3,594,122 | 7/1971 | Miller | 266/195 |

FOREIGN PATENT DOCUMENTS

| | | | |
|---|---|---|---|
| 449985 | 9/1927 | Fed. Rep. of Germany | 266/195 |
| 69865 | 10/1928 | Sweden | 222/200 |
| 445601 | 4/1936 | United Kingdom | 266/195 |
| 725906 | 3/1955 | United Kingdom | 266/195 |

*Primary Examiner*—Gerald A. Dost

*Attorney, Agent, or Firm*—Toren, McGeady & Stanger

[57] ABSTRACT

A furnace product is permitted to flow out by gravity from the opening defined between the lower end of a furnace wall and a furnace bottom and to accumulate on the circumferential portion of the furnace bottom with a reposing angle inherent to the product, with the accumulation being drawn out of the furnace from the circumferential portion of the furnace bottom. The furnace bottom is formed with a diameter larger than the inside diameter of the lower end of the furnace wall and vertically spaced from the lower end of the furnace so as to provide an opening therebetween through which the furnace product is allowed to pass a discharging device comprising a reciprocating raking arm with its end movable across the circumferential portion of the furnace bottom operates to remove product therefrom.

8 Claims, 4 Drawing Figures

SHAFT FURNACE WITH BOTTOM DISCHARGE DEVICE

BACKGROUND OF THE INVENTION

This invention relates to an improvement to a shaft furnace, and more particularly to improvements to the method and apparatus for discharging the furnace where the furnace feed is charged into the top of the furnace and the furnace product is discharged from the bottom of the furnace without undesirable crushing of the furnace product. The present invention is particularly advantageous for discharging a shaft furnace for direct reduction of lump iron ores, sinters or pellets, but may be applied for similar furnaces in many other fields.

PRIOR ART

In a known reduction process of an iron oxide ore where the furnace feed such as lump iron ores, sinters and pellets made from powder iron ore are charged to a shaft furnace by means of a charging device installed above the furnace, a reducing gas between 700° and 900° C. is supplied into the furnace from a gas blowing device provided at the lower or middle portion of the furnace and is brought into contact with the furnace charge descending by gravity in the furnace so as to reduce most of the iron ore into metallic iron and the charge thus reduced is discharged from the bottom of the furnace.

There is known also a limestone roasting process where limestone in lump and granular form is charged from the top of a vertical roasting furnace, hot gas between 900° and 1000° C. is supplied into the furnace from the bottom to roast the limestone, and the limestone thus roasted is discharged from the furnace bottom.

In the above conventional processes, the furnace product is discharged while being cooled or without being cooled.

As for an apparatus for discharging the cooled or hot furnace product from the furnace bottom, various apparatus have been disclosed, such as Japanese Laid-Open Patent 48-99020 and Japanese Patent Publication 40-7645, for example.

According to Japanese Laid-Open Patent 48-99020, a discharge plate is provided on the furnace bottom and caused to move reciprocatingly and horizontally to discharge the furnace product accumulating on the furance bottom.

Despite advantages inherent to this process, the following defects have been confronted by this process.

(1) As the discharge plate moves back and forth horizontally, the discharge plate has imposed thereon the total loads of the furnace charge.

(2) As the furnace product is discharged with the bottom having imposed thereon the furnace charge load, the product is subjected to large friction action caused among the product particles so that the product is crushed to a considerable degree.

(3) A long time is required for replacement or repair of the discharge plate.

According to Japanese Patent Publication 40-7645, a rotary table is provided at the furnace bottom and the product is discharged by the rotation of the rotary table supporting the load of the furnace charge. This method also has the following defects:

(1) The load imposed upon the rotary table is the total load of the furnace charge, and the load is too large.

(2) As the furnace product is discharged with the bottom having imposed thereon the furnace charge load, the product is subjected to large friction action caused among the product particles so that the product is crushed to a considerable degree.

(3) A long time is required for replacement or repair of the rotary table.

Thus, conventional discharging systems or devices have been found to display serious defects as mentioned above.

Therefore, one of the objects of the present invention is to provide a new method and device for discharging the shaft furnace product from the bottom of the furnace, which makes it possible (1) to discharge the furnace product in a uniform amount from the horizontal cross section of the furnace, (2) to minimize the crushing of the product, and (3) to simplify maintenance of the device and shorten the time required for replacement or repair of the discharge plate.

SUMMARY OF THE INVENTION

The method according to the present invention comprises allowing the furnace product to flow out by gravity from the opening defined between the lower end of the furnace wall and the furnace bottom to accumulate on the circumferential portion of the furnace bottom with a reposing angle inherent to the product, and discharging the accumulation out of the furnace from the circumferential portion of the furnace bottom.

The shaft furnace according to the present invention comprises a furnace bottom having a diameter larger than the inside diameter of the lower end of the furnace wall and vertically spaced from the lower end of the furnace so as to provide an opening therebetween through which the furnace product is allowed to pass, and a discharging device comprising a reciprocating raking arm with its end movable across the circumferential portion of the furnace bottom.

The present invention will be more clearly understood from the following description referring to the embodiments shown in the attached drawings.

DETAILED DESCRIPTION OF THE INVENTION

Figure 1:
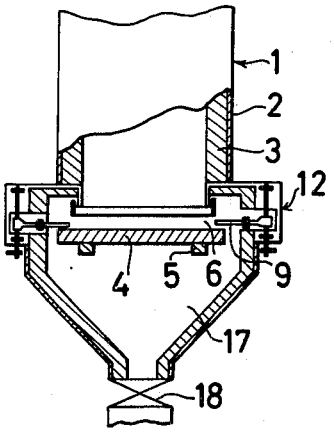
FIG. 1 is a cross sectional view of the bottom portion of the shaft furnace according to the present invention.

Referring to FIG. 1, the shaft furnace 1 is constructed with an outer iron shell 2 of cylindrical form and a refractory wall 3 lined on the inside of the shell 2. Below the lower end of the furnace wall 3, a furnace bottom 4 in the form of a stationary plate is fixedly provided, firmly supported by a beam member 5. Between the lower end of the furnace wall 3 and the upper side of the furnace bottom 4, there is provided an opening 6 large enough to permit the furnace product in the form of pellets for example having 10 to 30 mm diameter to pass therethrough. It is desirable that the opening is provided all around the furnace circumference. The furnace bottom 4 has a diameter or circumference larger than the inside diameter of the furnace wall 3. More specifically, the furnace bottom diameter or circumference is so large as to permit the furnace product flowing down by gravity through the opening to accumulate thereon with an inherent angle of repose as shown by the dotted line 7 in FIG. 2. It should be noted here that the base area of the accumulation varies depending on the height of the opening.

The furnace bottom 4 has usually a flat upper side as shown, but the central upper surface may take a conical shape projecting upward so as to facilitate the flow down of the product by gravity.

The feed such as lump ore, sinter, pellets charged from the top of the shaft furnace (1) is supported by the furnace bottom 4 to form a packed vertical layer. Under this condition, part of the furnace granular product at the bottom portion flows out by gravity through the opening 6 to accumulate on the circumferential portion of the bottom according to its inherent reposing angle. The accumulation thus formed is free from the direct loads of the furnace charge because it is outside the inside diameter of the furnace wall 3.

One of the features of the present invention is that the furnace product is allowed to flow down by gravity through the opening to form an accumulation according to its inherent reposing angle and the accumulation is discharged from the circumferential portion of the furnace bottom 4.

As for the means for discharging the accumulation on the circumferential portion of the furnace bottom, various devices may be used, but the discharging device as hereinafter described is most advantageous.

According to the present invention, the accumulation can be discharged with a very small driving energy, and the space from which the accumulation is discharged is occupied again with a new accumulation due to gravity.

Figure 2:
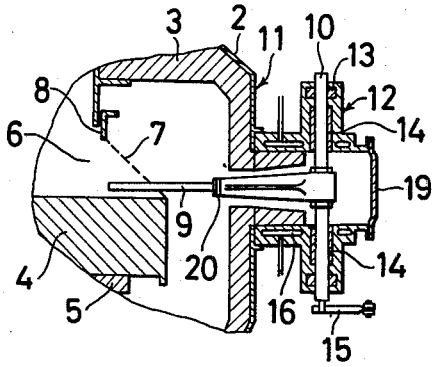
FIG. 2 is an enlarged view of the main portion of the apparatus according to the present invention.

The amount of the furnace product accumulating on the circumferential portion of the furnace bottom 4 can be varied depending on the height of the opening 6. Therefore, when it is desired to change the accumulation volume of the furnace product, the change can be attained by adjusting a position of the skirt member 8 movably provided around the lower end portion of the furnace wall 3 as shown in FIG. 2.

On the other hand, when the physical conditions of the feed to be charged to the shaft furnace, for example when the diameter or its distribution of the granular feed is changed, it is possible to maintain a desired accumulation volume by changing the position of the skirt member 8.

As described above, when the furnace product is discharged by raking out the accumulation formed on the circumferential portion of the furnace bottom 4 according to the present invention, only the accumulation formed by the gravity and inherent reposing angle is raked out so that the driving power required for raking out the furnace product can be almost constant, in contrast to the prior art where the required power must be changed in correspondence to changes of the furnace diameter and the level of the charge in the furnace.

Further, according to the present invention the furnace product accumulating on the circumferential portion of the furnace bottom 4 is raked down from the edge of the furnace bottom 4, so that the discharging device can be positioned circumferentially surrounding the furnace bottom. This positional condition permits the driving section or rotating section of the discharging device to be arranged at a remote position from the hot furnace granular product in the furnace, so that the furnace product can be discharged without positive cooling in the furnace 1.

Figure 3:
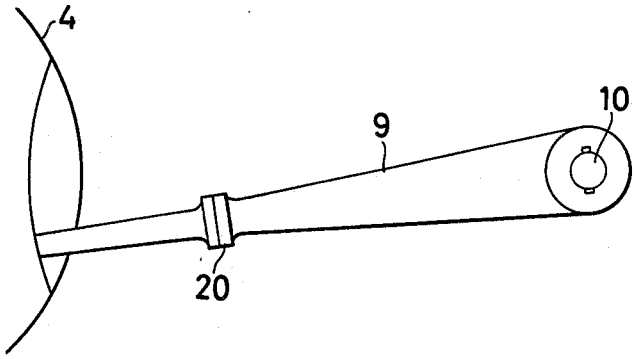
FIG. 3 schematically shows one mode of raking out the accumulation of the furnace product on the furnace bottom.

A preferable embodiment of the discharging device according to the present invention will be described referring to FIGS. 2, 3 and 4 in which a plurality of the discharging devices are arranged outwardly surrounding the furnace bottom 4.

As shown in FIG. 2 showing the main portion of the discharging device, the radially inner end of the raking arm 9 extends over the circumferential portion of the furnace bottom, while the radially outer end of the arm 9 is fixed by a shaft 10 which is rotatably supported through a bearing 13 by a frame member 12, which is, in turn, removably attached to the outer shell 11 of the furnace 1.

The mechanical space formed between the shaft 10 and the frame member 12 is sealed with a seal member 14. The lower end of the shaft 10 is connected to a driving mechanism (not shown) such as a piston cylinder through a connection bar 15.

Thus, when the driving mechanism is actuated the shaft 10 rotates to swing the raking arm 9 horizontally. If the arm 9 is designed to turn 360°, a large space is required and therefore a larger frame member is required. In order to eliminate these requirements efficiently, it is desirable to swing the arm 9 within a certain angle range, for example within a range of 30°.

It is not desirable that the base portion and the shaft 10 are affected by the heat from the furnace atmosphere and the furnace product. Therefore, it is desirable that a jacket 16 is formed in the frame member 12 supporting the shaft 10 for circulation of coolant such as cooling water therethrough.

Then, when the raking arm 9 is swung horizontally, partially over the circumferential portion of the furnace bottom, a portion of the accumulation with the inherent reposing angle of the furnace product flowing down by gravity through the opening 6, namely the portion of the accumulation corresponding to the area (shown by the dotted line) over which the raking arm swings is raked off from the edge of the furnace bottom and chuted down into a closed space 17 below the furnace bottom.

The furnace product discharged and stored in the closed space is moved to a subsequent process by operation of a valve 18.

Preferably, a plurality of the discharging devices with the raking arm 9 as described above are arranged circumferentially surrounding the furnace bottom 4.

Figure 4:
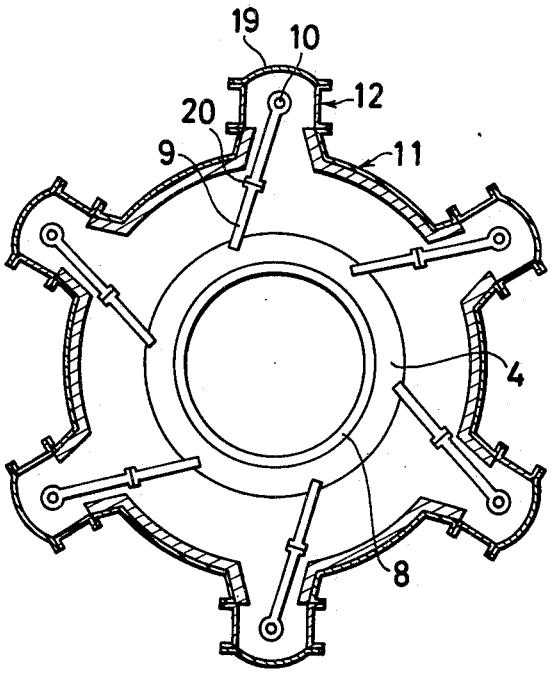
FIG. 4 is a cross section showing a plurality of the discharging device arranged outwardly around the furnace.

For example, in an embodiment shown in FIG. 4 where six discharging devices are arranged, all of the six devices may be actuated synchronously or they may be actuated successively in sequence one after another so as to adjust the volume of the furnace product to be discharged.

The six discharging devices, each comprising the raking arm and the frame member housing the rotation section of the arm, are arranged circumferentially around the furnace and they are circumferentially spaced from each other around the furnace.

In cases where the raking arm 9 is swung horizontally within a predetermined angle range, the volume of the furnace product to be discharged can be adjusted by varying the length of the arm.

When the arm is designed so as to swing over the furnace bottom vertically spaced therefrom a distance a little larger than the largest diameter of the granular product, preferably about two times larger than the average particle size of the product, it is possible to decrease the crushing effect of the swinging arm on the product. But when the level of the swing arm is higher, the volume of the product to be discharged decreases. However, the level of the arm 9 can be adjusted by controlling the attaching position of the arm on the shaft 10 by means of a spacer (not shown).

During continuous use of the discharging device as mentioned above, the raking front portion of the arm is susceptible to wear and thus it is necessary to detect such wear in time. It is also necessary to inspect the driving section for the raking arm 9.

In order to facilitate the above detection or inspection, it is preferable to provide a lid member 19 on the rear side of the frame member 12 (in FIG. 2). Thereby routine inspection can be performed by opening the lid member 19.

However, in event it happens to be necessary to replace the raking arm 9 at a specific section, the frame member at the specific section is removed together with the raking arm 9 and a new frame containing a new raking arm is replaced therefor. The frame member thus removed may be subjected to necessary repairs. Usually the raking arm is worn mainly in its outermost portion, and only the outermost portion need be replaced. This may be accomplished by means of a flange connection 20 which removably connects the outermost end of the arm 9 with its innermost end.

The cross sectional shape of the raking arm 9 may be of any shape such as circular, oval or square.

A shaft furnace having a discharging device as described above is most suitable for discharging high temperature furnace product. In cases where the discharging device is not exposed to high temperatures, the discharging device particularly the rotation section can be arranged more closely to the furnace product or the furnace atmosphere so that the length of the raking arm can be shortened.

As described above, according to the present invention, the furnace product flows down by gravity through the opening between the furnace wall and the furnace bottom which has a diameter larger than the inside diameter of the furnace wall and the product accumulates according to its inherent reposing angle on the circumferential portion of the furnace bottom. This accumulation is discharged by means of a separately provided discharging device, so that the furnace product is discharged under a condition free from the total load of the furnace charge and thus crushing action on the furnace product during the discharging operation can be remarkably reduced. The power consumption required for the discharging device can be considerably lessened as compared with the conventional art where the furnace product is discharged under the total load of the furnace charge.

Also according to the present invention a plurality of discharging devices provided circumferentially surrounding the furnace bottom are actuated so that it is possible to discharge the furnace product in an almost uniform quantity and thus the furnace charge descends uniformly from the top portion to the bottom portion of the furnace. This uniform descent of the furnace charge is an improvement over the conventional shaft furnace.

Further, according to the present invention the discharging device is supported by means of a frame member 12 removably attached around the outer circumference of the furnace so that the discharging device can be replaced very easily. While a specific embodiment of the invention has been shown and described in etail to illustrate the application of the inventive principles, it will be understood that the invention may be embodied otherwise without departing from such principles.

What is claimed:

1. A shaft furnace comprising an upper portion adapted to have a furnace feed charged thereinto, a furnace wall lower end adapted to have a furnace product discharged therefrom, said furnace wall lower end being configured with a given circumferential dimension, and a furnace bottom located directly beneath said furnace wall lower end and spaced therefrom a sufficient distance to provide therebetween an opening large enough to permit the furnace product to pass therethrough, said furnace bottom having a circumferential dimension larger than said given circumferential dimension of said furnace wall lower end, and a discharging device including at least one raking arm swingable over the circumferential portion of said furnace bottom, said shaft furnace further comprising driving means for driving a plurality of said discharging devices, said driving means being adapted to drive said plurality of discharge devices both synchronously and sequentially in a timed sequence.

2. A shaft furnace according to claim 1 wherein said raking arm swings through a horizontal plane.

3. A shaft furnace according to claim 1 wherein a plurality of said discharging devices are arranged circumferentially around said furnace.

4. A shaft furnace according to claim 1 wherein said discharging device comprises at least one frame member removably attached to the outer circumference of said furnace for replaceably supporting said raking arm.

5. A shaft furnace according to claim 1 wherein said discharging device comprises a plurality of frame members arranged about the periphery of said furnace bottom and circumferentially spaced from each other, each of said frame members operatively supporting a raking arm and being independently removable from said furnace.

6. A shaft furnace according to claim 1 further comprising a skirt member forming said furnace wall lower end, said skirt member being vertically movable relative to said furnace bottom to enable adjustment of the opening formed between said furnace bottom and said furnace wall lower end.

7. A shaft furnished according to claim 1 wherein said furnace bottom is formed with a circumference large enough to accommodate the accumulation of furnace product which is formed according to its inherent reposing angle on said furnace bottom.

8. A shaft furnace comprising an upper portion adapted to have a furnace feed charge thereinto, a furnace wall lower end adapted to have a furnace product discharged therefrom, said furnace wall lower end being configured with a given circumferential dimension, and a furnace bottom located directly beneath said furnace wall lower end and spaced therefrom a sufficient distance to provide therebetween an opening large enough to permit the furnace product to pass therethrough, said furnace bottom having a circumferential dimension larger than said given circumferential dimension of said furnace wall lower end, and a discharging device including at least one raking arm swingable over the circumferential portion of said furnace bottom, said shaft furnace further comprising driving means for driving a plurality of said discharging devices, said driving means being adapted to drive said plurality of discharge devices both synchronously and sequentially in a timed sequence, said raking arm being formed with a radially inner end and a radially outer end, said radially inner end being arranged to extend over said circumferential portion of said furnace bottom, said radially inner end being replaceably removable from said radially outer end.

* * * * *